US005669523A

United States Patent [19]

Mueller et al.

[11] Patent Number: 5,669,523

[45] Date of Patent: Sep. 23, 1997

[54] NON-METALLIC STACKABLE CONTAINERS WITH SPACED SUPPORTING SURFACES

[75] Inventors: Berthold Mueller, Suessen; Werner Stahlecker, Stuttgart, both of Germany

[73] Assignee: Ruediger Haaga GmbH, Germany

[21] Appl. No.: 720,171

[22] Filed: Sep. 25, 1996

Related U.S. Application Data

[63] Continuation of Ser. No. 452,147, May 26, 1996, abandoned.

[30] Foreign Application Priority Data

Jul. 9, 1994 [DE] Germany ..... 44 24 244.1

[51] Int. Cl.[6] ..... B65D 21/036

[52] U.S. Cl. ..... 220/4.27; 220/4.26; 206/509

[58] Field of Search ..... 206/508, 509; 220/4.26, 4.27

[56] References Cited

U.S. PATENT DOCUMENTS

| | | | |
|---|---|---|---|
| 1,534,803 | 4/1925 | Moore . | |
| 1,650,520 | 11/1927 | Johnson | 206/509 |
| 2,100,240 | 11/1937 | Cayo . | |
| 2,310,420 | 2/1943 | Graham . | |
| 2,553,559 | 5/1951 | Eckman | 220/4.27 |
| 2,899,096 | 8/1959 | Henchert et al. | 220/4.27 |
| 4,051,951 | 10/1977 | Smith | 206/508 |
| 4,363,404 | 12/1982 | Westphal | 206/509 |
| 4,785,992 | 11/1988 | Goeppner | 206/509 |
| 5,143,219 | 9/1992 | Yates, Jr. | 206/508 |

FOREIGN PATENT DOCUMENTS 92 11 788 2/1993 Germany .

*Primary Examiner*—Stephen J. Castellano
*Attorney, Agent, or Firm*—Evenson, McKeown, Edwards & Lenahan, P.L.L.C.

[57] ABSTRACT

A container comprises a tube-shaped container body which can be closed by a bottom and a lid. The container body has supporting surfaces which allow the containers to be stacked in a closed state. To improve the stability of a stack of containers, the supporting surfaces are so arranged that when stacked, a container body projects partly into the next container body.

3 Claims, 5 Drawing Sheets

NON-METALLIC STACKABLE CONTAINERS WITH SPACED SUPPORTING SURFACES

This application is a continuation of application Ser. No. 08/452,147, filed on May 26, 1995 now abandoned.

BACKGROUND AND SUMMARY OF THE INVENTION

Comprising a tube-shaped container body, a bottom, a lid for closing the container, and supporting surfaces for preventing the horizontal and vertical displacement of closed containers stacked on top of each other.

A container having a tube-shaped container body and a bottom which can be closed by a lid is shown in EP 595 497 A2. A plurality of containers with sealed lids can be stacked on top of each other, whereby the bottom of each container is placed on the essentially flush sealing lid of the next container. Supporting surfaces are provided for stacking in the known construction, and are supposed to prevent the displacement of containers stacked on top of each other. The supporting surfaces are arranged on the lid. Profilings projecting from the lid are intended to prevent horizontal displacement movements, and the plane surface of the lid fixes the position of the container in vertical direction.

A tray or cup-shaped container is shown in DE 37 39 547 C2, in which the opening can be closed with a sealing foil. A plurality of containers in an opened state can be stacked on top of each other. When stacked, the container body of one container projects into the container body of the next container and thus into its filling space. A stable stacking of closed containers is, however, not possible.

It is an object of the present invention to improve the stacking ability of closed containers while maintaining a simple container construction.

This object has been achieved in accordance with the present invention by providing that the supporting surfaces are so arranged that the container body of one closed container projects into the container body of the next closed container when stacked. Because the container body projects into the next container body, the supporting surfaces can be so constructed and arranged that the stability of the stack, in particular against tipping over sideways, is increased. A construction is made possible whereby when stacked, the supporting surfaces of two adjacent containers can fit closely against each other over a sufficiently large surface area. When stacked, the containers are in a position in which they fit into each other over a longitudinal area.

With respect to the present invention, the term "container body" is understood to refer to the tube-shaped area of the container in its entire axial length. It is not important whether the tube-shaped area is formed along its entire axial extent by a single wall or whether, for example, the edges projecting from the lid or the bottom form a longitudinal section by themselves or together with the above-mentioned wall.

In order to enable a container body to project into the next container body, the lid and/or the bottom of the container must be arranged sunk in relation to the longitudinal end of the container body in accordance with the above-mentioned definition. A container body projecting into the next container body does not need to come into contact with the next container's sunk lid or bottom, as long as one of the support surfaces is not arranged on the lid or bottom. In any event, a container body does not extend into the filling space of the next container body.

The present invention can be used for containers with any size of cross section, whereby containers with different sized cross sections along their length, for example, conical containers, can also be considered.

In an advantageous embodiment, the supporting surfaces which serve to prevent horizontal displacement are arranged at the two longitudinal ends of the container body in the area of the circumferential edges. A particularly simple construction is thus possible. Profilings in the area of the plane surface of the bottom or the lid are not necessary.

The supporting surfaces are so arranged that one supporting surface at the first longitudinal end corresponds to a supporting surface of the second longitudinal end. That is, the first and second supporting surfaces are, in relation to their form and arrangement, adapted to each other to such a degree that when stacking, the supporting surface of the first longitudinal end of a container comes to rest against the corresponding supporting surface of the second longitudinal end of the next container. The corresponding supporting surfaces are so formed and arranged that they fit on top of each other or, for example in the case of a rounded form, inside each other. The container body forms a recess at one longitudinal end into which, when stacked, the other longitudinal end of the next container can be inserted to a predetermined length.

It is of no importance for the arrangement of the supporting surfaces whether the lid or the bottom is arranged at one longitudinal end of the container body. The supporting surfaces can be arranged to the wall of the container body, the bottom or the lid of the container. The lid can be attached fixedly to the container body or, for example, be detachable for re-closing.

If the supporting surfaces are arranged only to the wall of the container body, the lid can be formed in any desired way. This results in the additional advantage of being able to stack the containers in an opened state, whereby the position of the lid is the same as when stacking closed containers. The supporting surfaces are preferably arranged continuously in the circumferential direction of the container body.

Another advantageous aspect of the present invention is that the supporting surfaces, which serve to prevent horizontal displacement, are so arranged that they extend at least approximately parallel to the axis of the container body. A particularly good stability against tipping over is hereby attained. The supporting surfaces need not be arranged exactly parallel. They can, for example, incline towards the axis of the container or extend curved, traverse to the circumferential direction. For example, they can be convex.

A still advantageous feature of the present invention is that a first supporting surface for preventing horizontal displacement is arranged to the inner circumferential side of a first longitudinal section lying at the first longitudinal end of the container body. A second supporting surface for preventing horizontal displacement is arranged on the outer circumferential side of a second longitudinal section, lying at the second longitudinal end of the container body. The two corresponding supporting surfaces are the same distance from the axis of the container and, insofar as they are inclined, take up the same angle in relation to the axis of the container. The container bodies can support each other in horizontal direction over the relatively large surface area of the adjacent supporting surfaces.

The longitudinal sections can have a larger axial area than the supporting surfaces arranged to them and can be formed by the wall of the container body. They can also be formed by a border section projecting upwardly from a lid or bottom. The upwardly projecting border section of the lid or bottom can form together with the wall of the container body the longitudinal section. The border section can rest on the inside or the outside of the container body. The longitudinal section can have an additional reinforcing material layer which is formed from, for example, a separate reinforcing ring, from the border section of the bottom or the lid or from a folded-over section of the wall.

The stability of the stack is further advantageously increased by the additional material layer. The supporting surfaces, which are arranged to the longitudinal section, can be arranged to the wall itself, or to a folded-over section of the wall, or to a border section of the lid or of the bottom, or to a reinforcing ring which is placed at the longitudinal section.

The first supporting surface which serves to prevent horizontal displacement is arranged to the first longitudinal section such that it extends along the inner circumferential side of the container body inside a recess. The second supporting surface which serves to prevent horizontal displacement is arranged to the second longitudinal section so that it extends along the outer circumferential side of the container body. The first and second supporting surfaces extend congruent to one another and equidistant from the axis of the container. Hence, when two neighboring containers are stacked, the first supporting surface of one container rests against the second supporting surface of the other container.

Because the first supporting surface at the first longitudinal section is arranged to the inner circumferential side and the second supporting surface at the second longitudinal side is arranged to the outer circumferential side, it is necessary to place the second longitudinal section nearer to the axis of the container than the first longitudinal section. This can be accomplished because the second longitudinal section is arranged out-of-line to the first longitudinal section. This out-of-line arrangement results in the container body having a smaller outer cross section at the second longitudinal section than at the first longitudinal section. The outer cross section of the second longitudinal section corresponds to the inner cross section of the first longitudinal section. The out-of-line arrangement can be attained by a conical construction of the container body extending lengthways and gradually tapering. The conical container body has a smaller cross section at the second longitudinal section than at the first longitudinal section.

It is also advantageous to construct the container body with a constant cross section lengthways, whereby at the second longitudinal section an abrupt radial contraction and/or at the first longitudinal section an abrupt radial enlargement is formed. The abrupt radial contraction leads to a smaller outer cross section in the case of the second longitudinal section. The abrupt radial enlargement leads to a larger cross section in the longitudinal section.

When stacking two containers, the longitudinal section with the smaller outer cross section, for example the area of the radial contraction of a container, is inserted partly into the recess of the container body of the next container. The two supporting surfaces of two neighboring containers, which surfaces serve to prevent horizontal displacement and are adapted to one another, lie fitting exactly against each other.

The supporting surfaces for preventing vertical displacement fix the position of the containers stacked on top of each other in vertical direction. The supporting surfaces extend at least approximately perpendicular to the axis of the container. A particularly good support in vertical direction is attained. The supporting surfaces do not need to be arranged exactly perpendicular to the axis. They can, for example, be inclined towards the perpendicular or follow a curved course, traverse to the circumferential direction. For instance, they can be convex.

The above mentioned supporting surfaces for preventing vertical displacement can be advantageously arranged to the plane section of the lid and/or the plane section of the bottom. It is, for example, possible that the lid is arranged sunk in the tube body such that when stacked, the bottom of the next container rests against the lid. In an advantageous embodiment, the two supporting surfaces for preventing vertical displacement are arranged to the two long ends of the container body in the area of the circumferential borders.

A yet further advantageous aspect of the present invention resides in the fact that a first supporting surface for preventing vertical displacement is arranged at the first long end on the front edge of the container body and a second supporting surface for preventing vertical displacement is arranged at the second long end on a web projecting upwardly from the container body. The position of the containers is fixed in the vertical direction when stacked, without the lid or the bottom being touched.

In another advantageous aspect, the first supporting surface for preventing vertical displacement is arranged at the first long end on a plane section of the lid or of the bottom, and the second supporting surface for preventing vertical displacement is arranged on the front edge of the container body. The front edge of the container body rests on the plane section of the lid or of the bottom of the next container when stacked.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
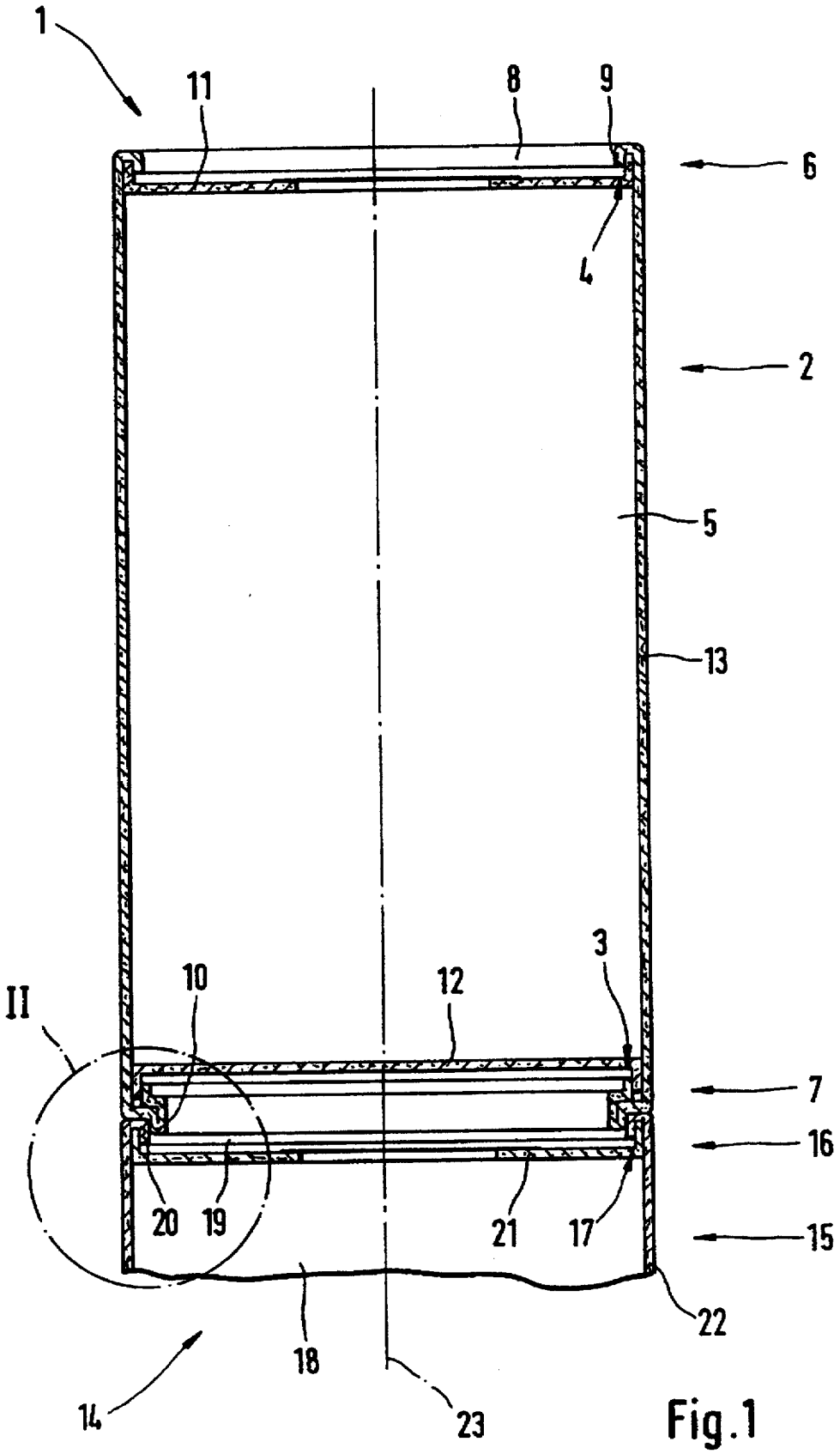
FIG. 1 is an elevational cross-sectional view of a cylindrical container in accordance with the present invention.

The can-shaped container 1 shown in FIG. 1 consists of a tube-shaped container body 2, a bottom 3 and a lid 4. The container body 2 has essentially the shape of a hollow cylinder, whereby in a longitudinal section, an area with a reduced cross section is formed as described below. The lid 4 is attached to the container body 2 at the first long end 6, and the bottom 3 is attached at the second long end 7 of the container 1 in a known manner. A plane section 12 forms the bottom 3, a plane section forms the lid 4 and a wall 13 forms the envelope of the container body 2; together they form a cylindrical filling space 5, in which the contents of the can are contained.

Another container 14 is partially shown in FIG. 1, and has the same construction as container 1. Container 14 also consists of a container body 15, a bottom (not shown) and lid 17 which is attached to the first long end 16 of the container 14. A plane section forms the bottom, a plane section 21 forms the lid 17, and together with a wall 22 of the container body 15, they also form a cylindrical filling space 18.

Both long ends 6, 7 of the container 1, as well as both long ends of the container 14, of which only the long end 16 is shown, are constructed so that stacking of several containers 1, 14 is allowed. As can be seen from FIG. 1, the container 1 is stacked on top of the identically constructed container 14. The second long end 7 of the container body 2 thereby projects partly into the first long end 16 of the container body 15. The first long end 6 of the container 1 is constructed in the same way as the first long end 16 of the container 14, so that a further container (not shown) could be stacked on top thereof.

The stacking capability of the containers 1, 14 is, as already mentioned, made possible by the special construction of the two long ends 6, 7 or 16 of the containers 1, 14, which will now be described. At the first long end 6 of the container 1, the plane section 11 of the lid 4 is sunk a little in the axial direction into the inside of the container body 2, to form, in a first longitudinal section bordering the front edge, a recess in the form of a cylindrical hollow space 8. In the same way, a first longitudinal section 20 comprising a cylindrical hollow space 19 is formed at the first long end 16 of the container 14 by a corresponding sunken arrangement of the lid 17.

Figure 2:
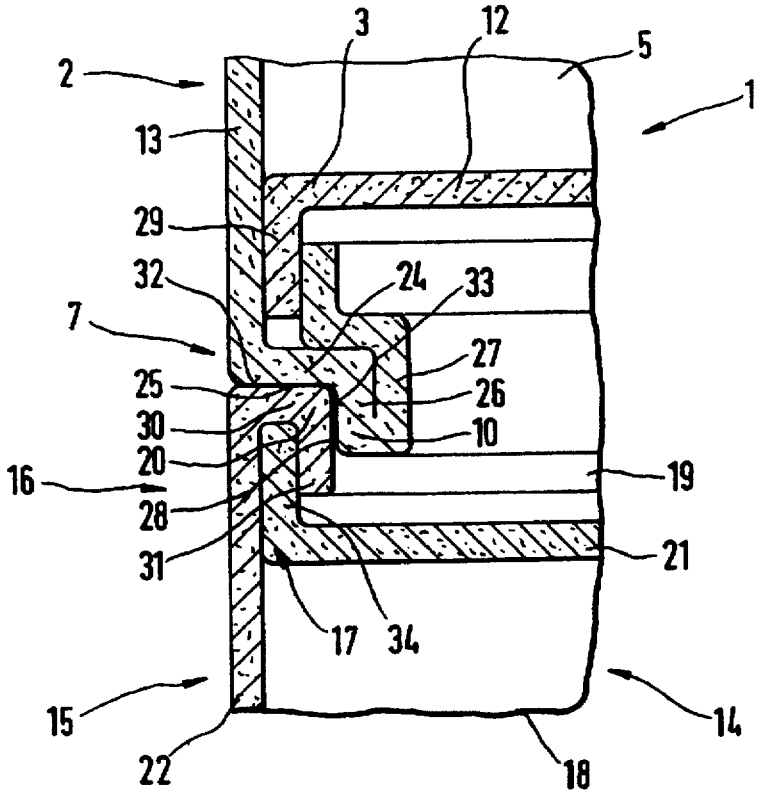
FIG. 2 is an enlarged section of the area II of the container shown in FIG. 1.

Referring now to FIG. 2, the first longitudinal section 20 comprising the cylindrical hollow space 19 of the container 14 is made by appropriate shaping of the wall 22 of the container body 15 and the lid 17. The wall 22 of the container body 15 is folded over in the direction towards the axis 23, to attain a radially placed, ring-shaped web which forms the front edge of the container 14. The wall 22 is folded over again where it is connected to the web 30, namely in the direction of the sunken plane section 21 of the lid 17 of the container 14, so that a section 31 of the wall 22 is formed which extends essentially parallel to the axis 23.

The lid 17 is folded over away from the filling space 18 in its edge area. Thus, an edge section 34 of the lid 17 projects from the plane section 21, rests on the inside of the wall 22 and is covered by the folded-over section 31 of the wall 22. A section with a plurality of material layers is hence formed at the first longitudinal section 20 of the container body 15. The inner cross-section of the first longitudinal section 20 of the container 14 and, therefore, also the cross section of the cylindrical hollow space 19 are determined by the arrangement and the direction of extension of the folded-over section 31.

The container body 2 of the container 1 comprises at its second long end 7 a second longitudinal section 10 with a radial contraction. The outer cross section is thus reduced at this point. The contraction is such that the container 1 with the above mentioned second longitudinal section 10 can be inserted into the formed hollow space 19 at the first longitudinal section 20 of the container 14. The outer cross section of the second longitudinal section 10 hereby corresponds to the inner cross section of the first longitudinal section 20.

The second longitudinal section 10 with a radial contraction is attained by appropriate shaping of the wall 13. As can be seen in FIG. 2, the wall 13 of the container body 2 at the second long end 7 of the container 1 is folded over in such a way that a ring-shaped web 24, projecting in the direction towards the inside of the container 1, is formed. This web 24 is directed radially, i.e., it extends parallel to the plane section 12 of the bottom 3. The web 24 is thus placed perpendicular, as are the plane sections 11, 12, 21 of the bottom 3 and the lid 4, 17 (as seen in FIG. 1), to the axis 23 of the containers 1, 14.

As can be further seen in FIG. 2, the wall section 13 following the web 24 is folded over again, namely in the direction away from the filling space 5. A folded-over section 26 of the wall 13, extending parallel to the axis 23 shown as FIG. 1 is thus formed. Along the axial extension of the section 26, the container 1 has a reduced outer cross section to form the second longitudinal section 10 with a radial contraction in this area.

The wall 13 is folded over again where it is connected to the section 26, namely in the opposite direction, i.e., in the direction towards the filling space 5 of the container 1. This inner section 27, placed towards the filling space 5, rests against the section 26, so that two sections 26, 27 of the second longitudinal section 10 form two material layers. The bottom 3 is provided in its border area with a border section 29, which projects from the plane section 12 of the bottom 3. The border section 29 lies against the inside of the wall 13 and is covered by the section 27 of the wall 13 which extends in the direction of the filling space 5 and the bottom 3. The border section 29 is attached to the container body 2, preferably by heat sealing.

The container 1 projects with its second longitudinal section 10 into the first longitudinal section 20 of the container 14, as above mentioned. The container body 2 hereby fits exactly onto the container body 15, as now described. At the first long end 16 of the container body 15, a radially directed surface, that is, extending perpendicular to the axis 23, is formed on the web 30 and is constructed as a first supporting surface 32 of the container 14 for preventing vertical displacement. At the first longitudinal section 20 of the container body 15, a surface, placed parallel to the axis 23, is formed which extends on the inner circumferential side of the first longitudinal section 20, that is on the folded-over section 31, and which serves as a first supporting surface 33 of the container 14 against horizontal displacement. As used throughout this written description of the invention and in the appended claims, reference to a supporting surface is intended to include a surface which can support the mentioned container as well as a container stacker thereon.

At the second long end 7 of the container body 2, a radially directed surface, that is, also extending perpendicular to the axis 23, is formed on the web 24, and is constructed as a second supporting surface 25 of the container 1 for preventing vertical displacement. At the second radially contracted longitudinal section 10 of the container body 2, a surface which placed parallel to the axis 23 is formed to extend on the outer circumferential side of the second longitudinal section 10, and serve as a second supporting surface 28 against horizontal displacement of the containers 1 and 14. The second supporting surface 28 of the container 1 fits exactly against the first supporting surface 33 of the container 14 to assure prevention of horizontal displacement. The second supporting surface 25 of the container 1 fits exactly against the first supporting surface 32 of the container 14 to assure prevention of vertical displacement.

Figure 3:
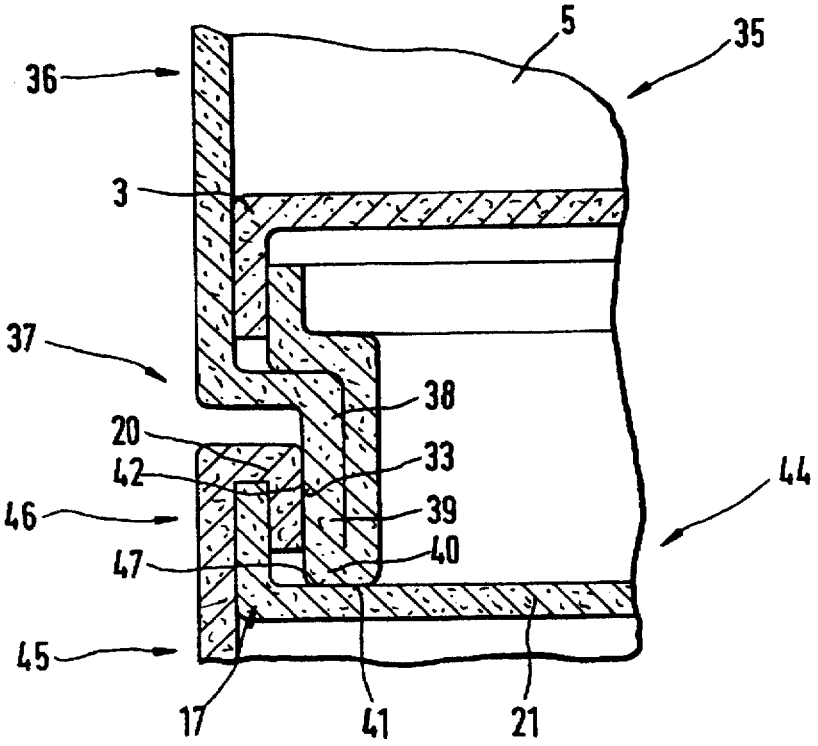
FIG. 3 is a still further enlarged sectional view of a first different construction of a cylindrical container similar to the embodiment in FIG. 2.

The containers 35, 44 in the embodiment of FIG. 3 have approximately the same construction as the containers 1, 14 of FIGS. 1 and 2. More particularly in the areas of their first long ends, of which only the long end 46 is shown, the containers 35, 44 are identical to the containers 1, 14. The lid 17 of the container 44 is attached to the container body 45 in the named area, whereby the plane section 21 is placed perpendicular to an axis which corresponds to the axis 23 in FIG. 1. The lid 17 is sunkingly arranged, so that a hollow area, corresponding to the hollow areas 8, 19 of FIGS. 1 and 2, is formed.

The containers 35, 44 of FIG. 3 differ from the containers 1, 14 of FIGS. 1 and 2 in the areas of their second long ends, only the long end 37 of which is shown. The container body 36 of the container 35, which is identical in construction to the container 44, has indeed a second longitudinal section 38 with a radial contraction, as does the container body 2 of the container 1 shown in FIGS. 1 and 2. This longitudinal section 38 has the same outer cross section as the second longitudinal section 10, comprising the radial contraction, of the container body 2 as shown in FIG. 2. The second longitudinal section 38 differs from the second longitudinal section 10 in that the section 39 of the longitudinal section 38, extending vertically in the direction of the lid 17, has a longer axial length than the corresponding section 26 of the container body 2. With this larger axial length of the second longitudinal section 38, the front edge 40 thereof to the plane section 21 of the lid 17. The front edge 40 thus forms at its front surface a second supporting surface 41 to prevent vertical displacement of the container 35. At the plane section of the lid 17, a first supporting surface 47 is formed to prevent vertical displacement. The first supporting surface 47 and the second supporting surface 41 rest against each other, so that the vertical position of the containers 35, 44 is fixed.

At the vertically extending section 39 of the second longitudinal section 38, a second supporting surface 42 to prevent horizontal displacement is fixed at the container 35. This second supporting surface 42 is arranged in the same way as the second supporting surface 28 of the container 1 and differs therefrom only in its longer axial length. The second supporting surface 42 rests fitting exactly against the first supporting surface 33 of the container 44, which has already been described in detail in connection with FIG. 2. Horizontal displacement is thus positively prevented. Alternatively, the container body can be of slightly conical form, whereby the supporting surfaces are arranged in the area of a recess and an abrupt radial contraction, identical to the embodiments described above.

Figure 4:
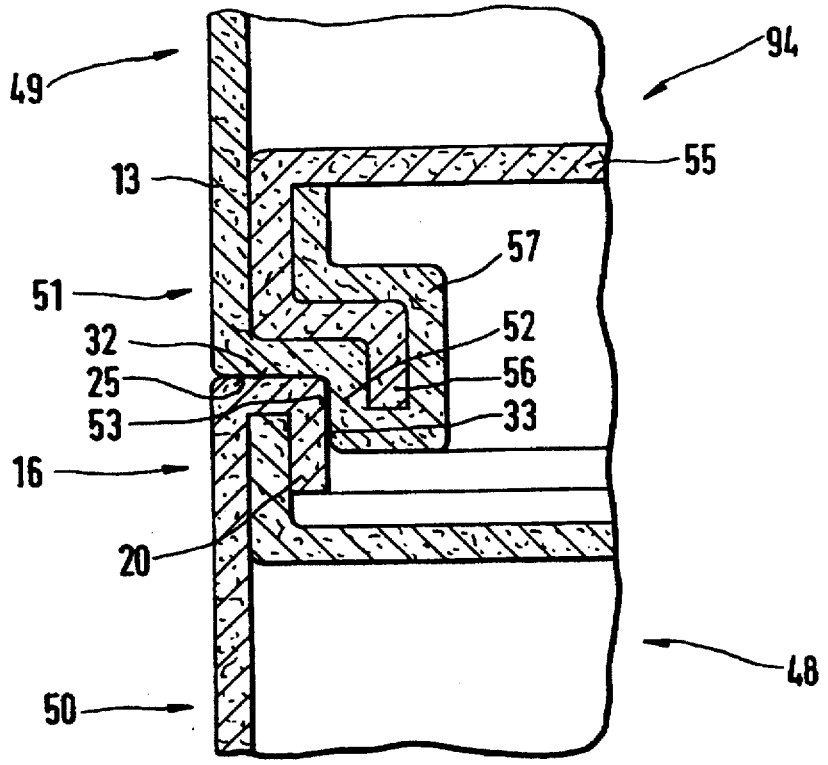
FIG. 4 is an enlarged section of a second different construction of a cylindrical container similar to the embodiment in FIG. 2.

The containers 94, 48 of FIG. 4 are approximately similar in construction to the containers 1, 14 of FIGS. 1 and 2. In the area of their first long ends, of which only the long end 16 is shown, the containers 94, 48 are identical to the containers 1, 14. The containers 94, 48 differ from the containers 1, 14 in the areas of their second long ends, of which only the long end 51 is shown. The container body 49 of the container 94, which is identical in construction to the container 48, comprises at its second long end 51, as does the container body 2 of the container 1, a radially contracted second longitudinal section 52 having the same outer cross section as the second longitudinal section 10 of the container body 2 shown in FIG. 2. A vertically placed supporting surface 53, extending in the circumferential direction, is also arranged at the second longitudinal section 52 to prevent horizontal displacement.

The container body 49 differs from the container body 2 in the different construction and arrangement of a bottom 55 arranged at the second long end 51. The bottom 55 has a projecting edge with an edge section 56 which reaches the area of the second longitudinal section 52 and is there completely covered by a folded-over section 57 of the wall 13 of the container body 49.

Figure 5:
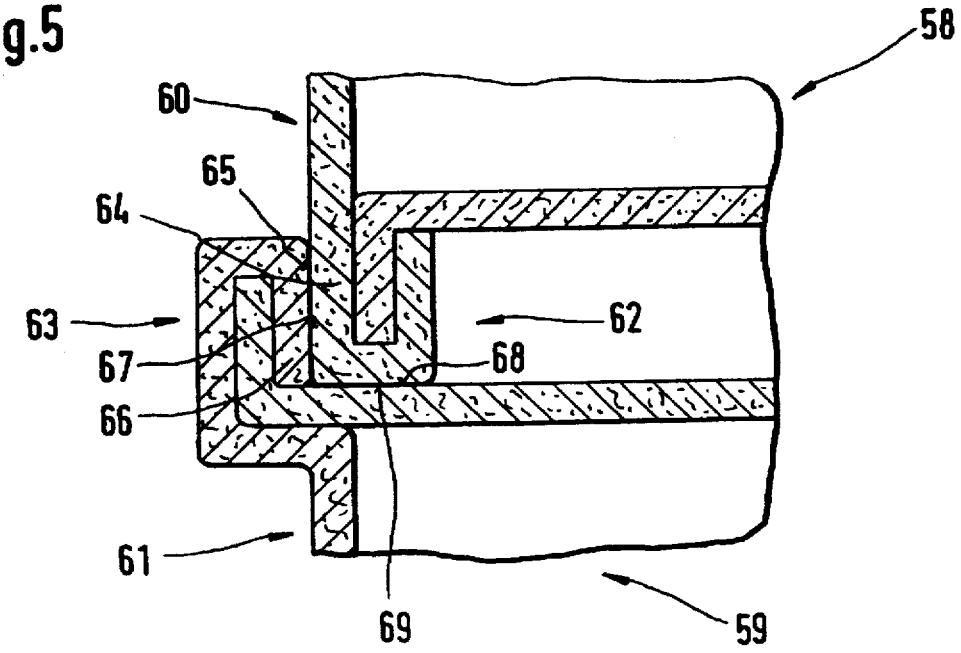
FIG. 5 is an enlarged section of a third different construction of a cylindrical container similar to the embodiment in FIG. 2.

The containers 58, 59 of the embodiment of FIG. 5 have container bodies 60, 61, with an essentially cylindrical form, as do the containers 1, 14, 35, 44, 94, 48 shown in FIGS. 1 to 4. Longitudinal sections 64, 66 at the long ends 62, 63 of the container bodies 60, 61, are so arranged that the container 58 projects with its second long end 62 partly into the first long end 63 of the container 59. The second longitudinal section 64 of the container body 60 is, in relation to the first longitudinal section 66 of the container body 61, arranged out-of-line. The outer cross section of the second longitudinal section 64 corresponds to the inner cross section of the first longitudinal section 66. However, the outer cross section of the second longitudinal section 64 is not smaller than the outer cross section of the area which adjoins the second longitudinal section 64 in axial direction and thus radial contraction is not present. The out-of-line arrangement is attained in that a radial enlargement is formed at the first longitudinal section 66. In the area of the first longitudinal section 66, the outer cross section of the container body 61 is enlarged relative to the area bordering the first longitudinal section 66 in the axial direction.

In the position shown in FIG. 5 in which the container 58 partly projects into the container 59, a vertical supporting surface 65 of the second longitudinal section 64 rests against a vertical supporting surface 67 of the first longitudinal section 66. A horizontal supporting surface 69, arranged at the second long end 62 of the container body 60, rests against a horizontal supporting surface 68 arranged at the first long end 63 of the container 59. Similar to the embodiment in FIG. 3, the horizontally placed supporting surface 68 does not engage to the container body 61 but rather the lid of the lower container body 61.

Figure 6:
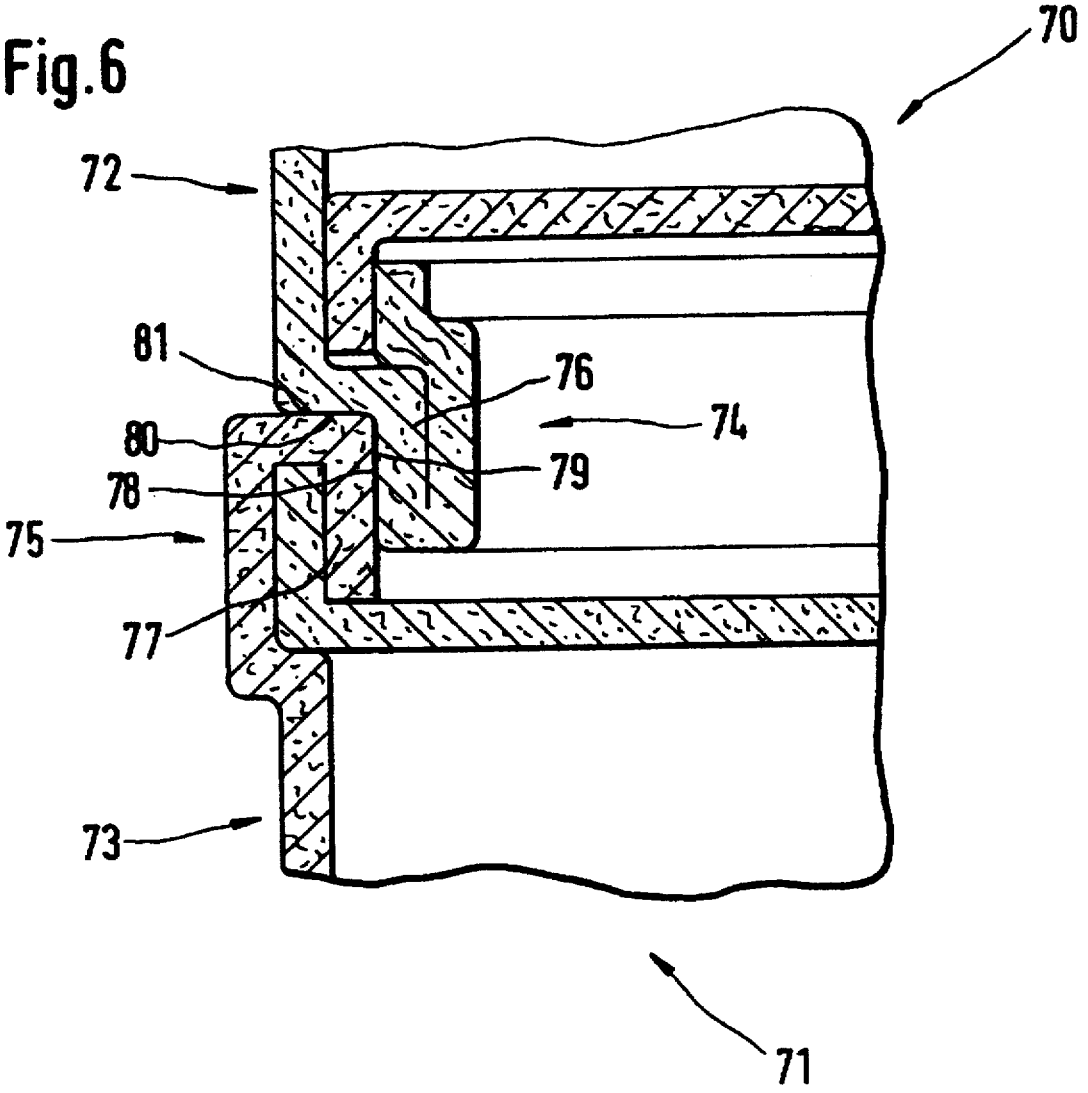
FIG. 6 is an enlarged section of a fourth different construction of a cylindrical container similar to the embodiment in FIG. 2.

The containers 70, 71 shown in FIG. 6 have container bodies 72, 73 with essentially cylindrical form. Horizontal supporting surfaces 80, 81 are provided at the long ends 74, 75 of the container bodies 72, 73, and rest against each other when the containers 70, 71 project into each other as in the illustrated position. At the long ends 74, 75, longitudinal sections 76, 77 have vertically placed supporting surfaces 78, 79 which rest against each other when the containers 70, 71 project into each other. The second longitudinal section 76 arranged at the second long end 74 of the container body 72 is, in relation to the first longitudinal section 77 at the first long end 75 of the container body 73, arranged out-of-line. This out-of-line arrangement is attained by a radial contraction of the second longitudinal section 76 as well as by a radial enlargement of the first longitudinal section 77.

Figure 7:
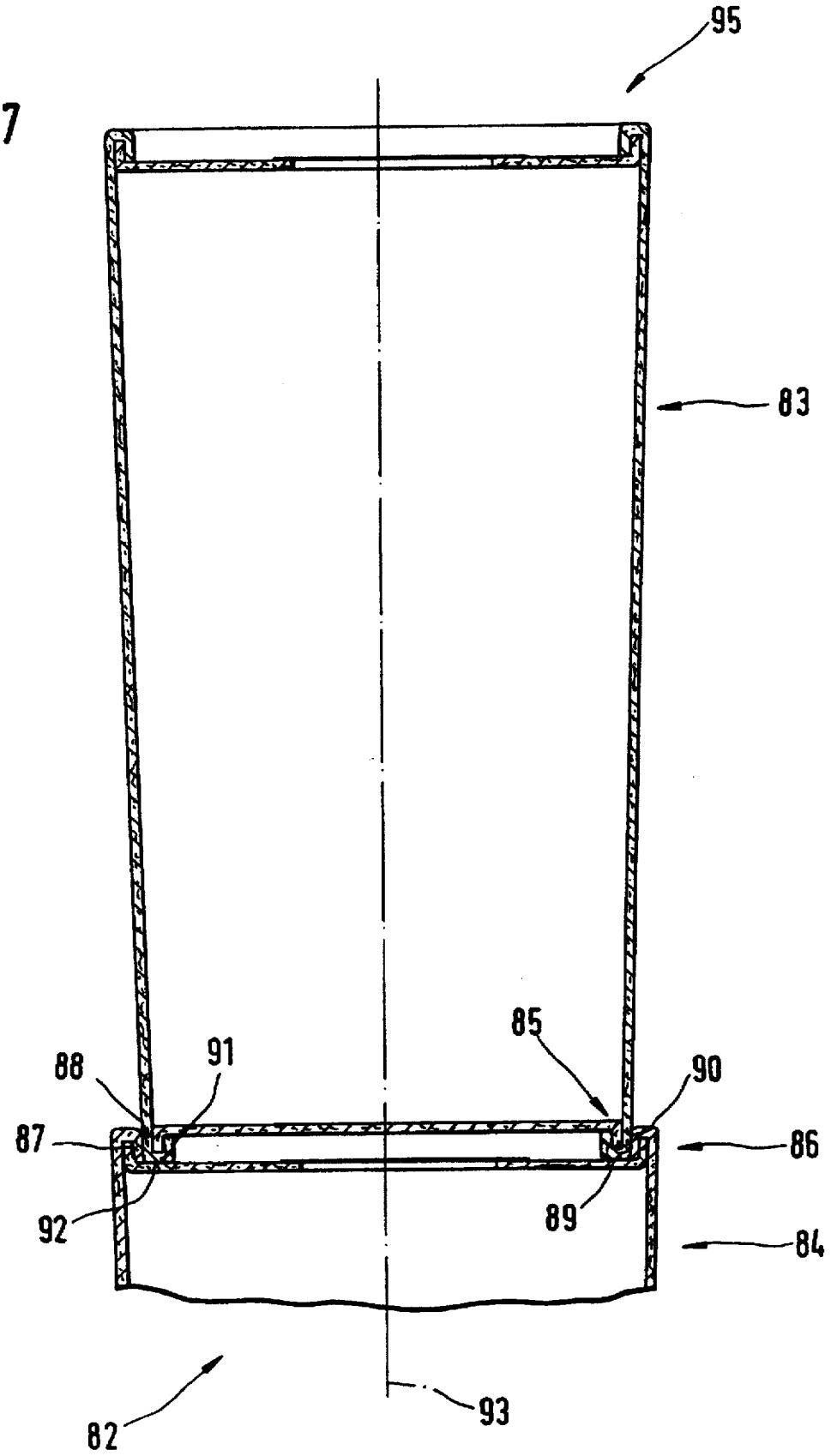
FIG. 7 is an elevational cross-sectional view of a conical container similar to the embodiment in FIG. 1.

The containers 95, 82 shown in FIG. 7 each have a conical form, i.e., the cross section of the container bodies 83, 84 decreases continuously in the longitudinal direction of the containers 95, 82. The second longitudinal section 88 situated at the second long end 85 of the container body 83 has a smaller outer cross section than the first longitudinal section 87 of the container body 84 situated at the first long end 86. The out-of-line arrangement of the second longitudinal section 88 relative to the first longitudinal section 87 is due to the conical form of the containers 95, 82.

In FIG. 7, the container 95 projects partly with its second long end 85 into the first long end 86 of the container 82. In this position, a supporting surface 90, placed essentially vertically but, according to the conical shape also slightly inclined, rests against an identically placed supporting surface 89 of the first longitudinal section 87. A supporting surface 92, situated at the second long end 85 of the container 95 and placed horizontally, rests against a supporting surface 91 arranged to the first long end 86 of the container 82 and identically placed.

The above-described containers do not have to have ring-shaped cross sections. The cross sections can alternatively be rectangular with, if required, rounded corners. Moreover, the containers are preferably made from blanks of coated cardboard.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A container, comprising a tube-shaped container body, a bottom, a lid for closing the container, and at least one first supporting surface arranged at a first long end of the container body and at least one second supporting surface arranged at a second long end of the container body, wherein at least one of the first and second supporting surface are configured such that, when the container is stacked on a second container having at least one complementary supporting surface, the container body of the first-mentioned container projects into a container body of the second container with the bottom of the first-mentioned container spaced from a lid of the second container to prevent horizontal and vertical displacement of the stacked containers while permitting the containers to be easily separated, wherein the at least one of the first and second supporting surfaces extend at least approximately perpendicular to a longitudinal axis of the container body to prevent vertical displacement, wherein the at least one first supporting surface is arranged on a front border of the container body, and the second supporting surface is arranged on a web projecting from the container body.

2. The container according to claim 1, wherein at least one of the supporting surfaces for preventing vertical displacement is arranged on a plane section on one of the lid and of the bottom.

3. The container according to claim 2, wherein the first and second supporting surfaces for preventing vertical displacement are arranged at the long ends of the container body in the circumferential border area thereof.

* * * * *